US006146286A

United States Patent [19]

Masuda

[11] Patent Number: 6,146,286

[45] Date of Patent: Nov. 14, 2000

[54] GOLF CLUB HEAD AND A GOLF CLUB USING THIS HEAD

[75] Inventor: Masayoshi Masuda, Kamakura, Japan

[73] Assignee: MacGregor Golf Japan LTD, Tokyo, Japan

[21] Appl. No.: 09/067,097

[22] Filed: Apr. 25, 1998

[30] Foreign Application Priority Data

Apr. 25, 1997 [JP] Japan ..... 9-123407

[51] Int. Cl.[7] ..... A63B 53/02

[52] U.S. Cl. ..... 473/305; 473/309; 473/311; 473/345

[58] Field of Search ..... 473/305, 306, 473/307, 308, 309, 310, 311, 312, 313, 314, 315, 345

[56] References Cited

U.S. PATENT DOCUMENTS 713,845 11/1902 Braid et al. .
5,042,806 8/1991 Helmstetter .
5,149,091 9/1992 Okumoto ..... 473/343
5,335,909 8/1994 Green ..... 473/310
5,452,890 9/1995 Bingham ..... 473/311
5,575,723 11/1996 Take et al. ..... 473/310
5,797,806 8/1998 Butler ..... 473/310
5,888,149 3/1999 Allen ..... 473/309

*Primary Examiner*—Sebastiano Passaniti
*Attorney, Agent, or Firm*—Hopgood, Calimafde, Kalil & Judlowe, LLP

[57] ABSTRACT

A golf club head includes a tubular shaft attaching portion which is provided to a hosel portion so as to serve as a fixing portion that fixes a distal end portion of a shaft to the head. The tubular shaft attaching portion has an upper end which is located below a corresponding upper surface of a crown portion. In this head, the effective length of the shaft that can flex during a golf swing can be extended at the distal end portion, so that the head speed can be increased by sufficiently utilizing the flexure at the distal end portion of the shaft. Also, damage to the shaft can be prevented effectively.

16 Claims, 5 Drawing Sheets

GOLF CLUB HEAD AND A GOLF CLUB USING THIS HEAD

BACKGROUND OF THE INVENTION

1. Field of the Invention

This present invention relates to a golf club head having a hosel portion that fixes the distal end portion of the shaft, and a golf club using this head.

2. Description of the Prior Art

In recent years, as golf clubs called wood clubs, those having a head molded into a hollow shell body from a metal (e.g., stainless steel, a titanium alloy, an aluminum alloy or the like), or a reinforced synthetic resin (e.g., a carbon fiber reinforced plastic), in place of a natural material such as persimmon or cherry wood are widely used from the viewpoints of stability in quality and easiness in supply of the material. Various types of structures for improving the attaching strength of the shaft are proposed as the structure of the hosel portion of the head molded into the hollow shell body.

In order to extend the fly distance of a golf ball when the golf ball is hit with a golf club, the length of that portion of the distal end portion of the shaft which is fixed to the hosel portion of the head is decreased as much as possible, and the flexure of the distal end portion of the shaft during a golf swing is sufficiently utilized, so that the speed of the head is sufficiently increased.

The hosel portion of the head of any conventional wood club cannot increase the head speed by sufficiently utilizing the flexure of the shaft although its shaft attaching strength may be improved.

SUMMARY OF THE INVENTION

It is, therefore, the primary object of this invention to provide a golf club head in which the effective length of the shaft that can flex during a golf swing can be extended at the distal end portion as compared to that in a conventional golf club, and the flexure at the distal end portion of the shaft is sufficiently utilized, so that the head speed can be increased.

It is another object of this invention to provide a golf club head in which damage to the shaft can be effectively prevented.

This invention relates to a golf club head comprising a tublar shaft attaching portion provided to a hosel portion so as to serve as a fixing portion that fixes a distal end portion of a shaft to the head, wherein the tublar shaft attaching portion has an upper end which is located below a corresponding upper surface of a crown portion.

This invention also relates to a golf club comprising a golf club head having an arrangement as described above and a shaft, a distal end portion of which is fixed to the hosel portion of the head.

The above, and other, objects, features and advantages of this invention, will become readily apparent from the following detailed description thereof which is to be read in connection with the accompanying drawings.

DESCRIPTION OF THE PREFERRED EMBODIMENTS

The first to third embodiments in which this invention is applied to a driver, among golf clubs, will be described with reference to the accompanying drawings.

First Embodiment

A golf club according to the first embodiment of this invention shown in FIGS. 1 and 2 will be described.

Figure 1:
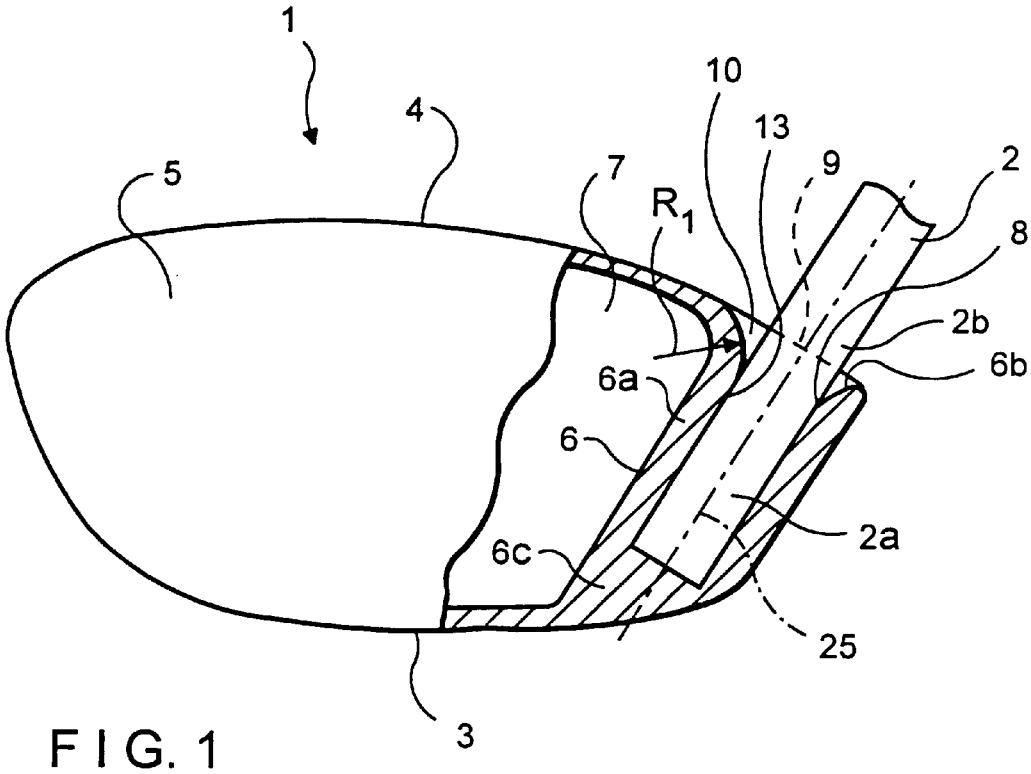
FIG. 1 is a partially longitudinally sectional front view of the hosel portion and its vicinity of a golf club according to the first embodiment of this invention, in which the shaft is omitted except for its distal end portion.
Figure 2:
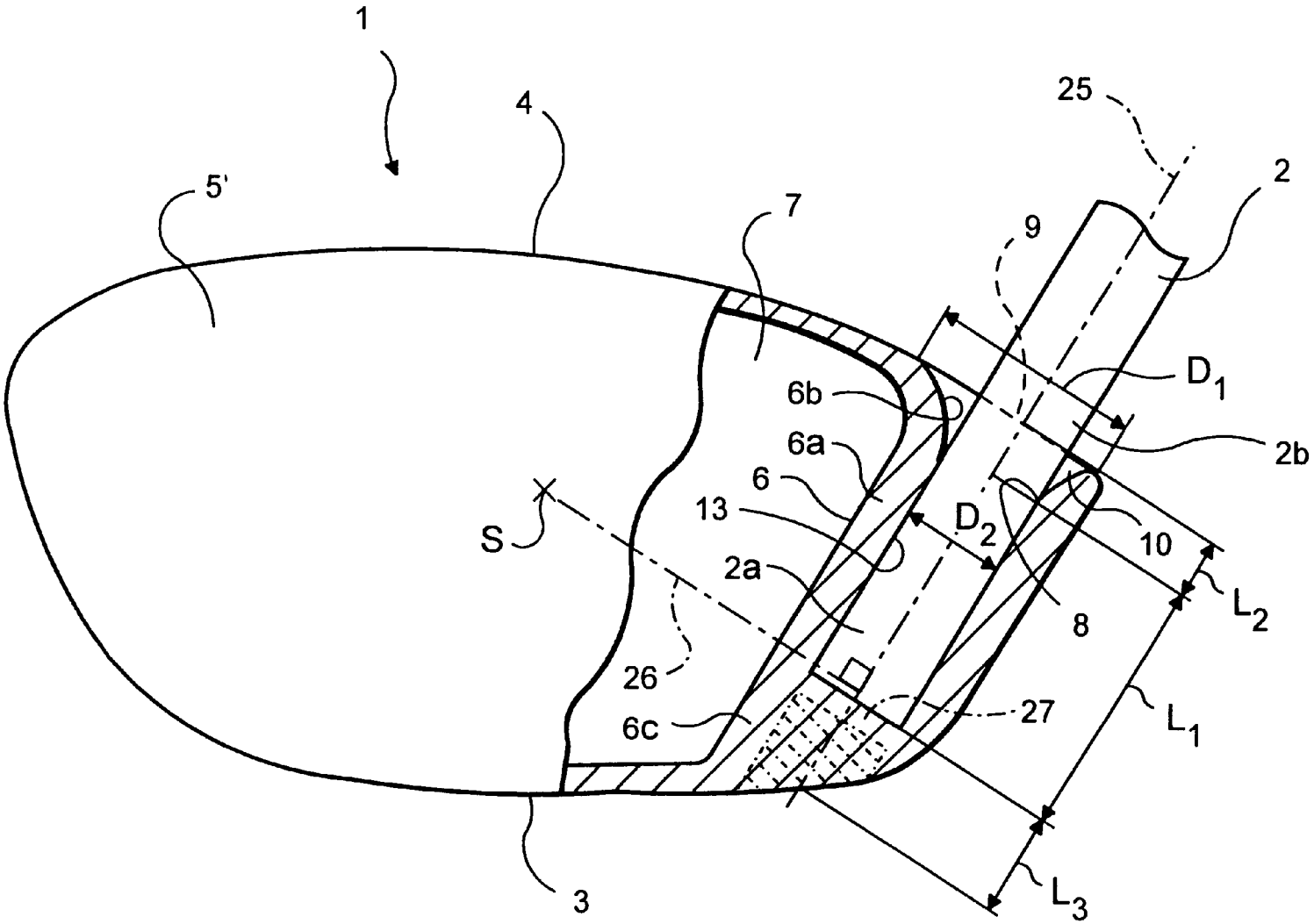
FIG. 2 is an enlarged view of FIG. 1.

The golf club shown in FIGS. 1 and 2 has a head 1 and a shaft 2. The head 1 is made into a hollow shell body from a metal, e.g., stainless steel, a titanium alloy, an aluminum alloy or the like, a reinforced synthetic resin (e.g., an FRP (fiber reinforced plastic) such as a carbon fiber reinforced plastic), or other materials. The shaft 2 is made into a hollow rod-like body from a metal (e.g. a titanium alloy, stainless steel, aluminum alloy or the like), a reinforced synthetic resin (e.g., an FRP such as a carbon fiber reinforced plastic), or other materials. A distal end portion 2*a* of the shaft 2 is attached to the head 1. As the carbon fiber reinforced plastic, one obtained by reinforcing a hard synthetic resin (e.g., an epoxy resin) with a carbon fiber can be used.

The head 1 may be constructed of two pieces by separately molding a sole portion 3 and a portion other than the sole portion 3 (i.e., an integral mold product of a crown portion or top portion 4, a face portion 5, a hosel portion or neck portion 6 and the like), and welding the two portions. Or, the head 1 may be constructed of two pieces by separately molding the face portion 5 and a portion other than the face portion 5 (i.e., an integral mold product of the sole portion 3, the crown portion 4, the hosel portion 6 and the like), and welding the two portions. Alternatively, the head 1 may be constructed of three pieces by integrally molding the face portion 5 and the hosel portion 6 as an integral mold product, separately molding the sole portion 3 and the crown portion s4 and welding the sole portion 3 and the crown portion 4 to the integral mold product. Also, the head 1 may be constructed of one piece by integrally molding its entire portion by ultra-plastic molding.

The head 1 may have a conventionally known head shape or a shape similar to it except for an upper portion of the hosel portion 6 and its vicinity. In FIGS. 1 and 2, the score formed in the face portion 5 is omitted. The shaft 2 may have a conventionally generally known shaft shape or a shape similar to it.

The thickness of the head 1 may differ among the sole portion 3, the crown portion 4, the face portion 5 and the hosel portion 6. It is preferable that the thickness increases in the order of the crown portion 4, the sole portion 3 and the face portion 5. The thickness of the sole portion 3 is about 2 mm in the case of the embodiment shown in FIGS. 1 and 2 but generally preferably falls within the range of about 1 mm to about 3.5 mm from the practical viewpoint, and more preferably falls within the range of about 1.5 mm to about 3 mm. The thickness of the crown portion 4 is about 1.5 mm in the case of the embodiment shown in FIGS. 1 and 2 but generally preferably falls within the range of about 0.5 mm to about 3 mm from the practical viewpoint, and more preferably falls within the range of about 0.8 mm to about 2.4 mm. The thickness of the face portion 5 is about 3 mm in the case of the embodiment shown in FIGS. 1 and 2 but generally preferably falls within the range of about 1.6 mm to about 6 mm from the practical viewpoint, and more preferably falls within the range of about 2.5 mm to about 4.5 mm. In the boundary areas among the sole portion 3, the crown portion 4 and the face portion 5, it is preferable that one thickness continuously change to another thickness. The thickness of the hosel portion 6 will be described later.

The hosel portion 6 can be integrally molded with the crown portion 4 and/or the sole portion 3, as shown in FIGS. 1 and 2. In the embodiment shown in FIGS. 1 and 2, the heel side portion of the hosel portion 6 is integrally formed with the corresponding portion of the crown portion 4. The hosel portion 6 extends with a tilt from the vicinity of the crown portion 4 (i.e., the vicinity of the face portion 5 on the heel side of the crown portion 4) toward an internal space 7 of the head 1 substantially tubularly (e.g., substantially cylindrically or substantially circularly cylindrically) to reach the sole portion 3. The hosel portion 6 has a tubular (e.g., cylindrial or circularly cylindrical) shaft attaching portion 6*a*, an upper connecting portion 6*b* and a lower connecting portion 6*c*. The cylindrical shaft attaching portion 6*a* extends with a tilt toward the internal space 7 of the head 1. The upper connecting portion 6*b* integrally connects an upper end of the shaft attaching portion 6*a* to the crown portion 4. The lower connecting portion 6*c* integrally connects a lower end of the shaft attaching portion 6*a* to the sole portion 3. The shaft attaching portion 6*a*, the upper connecting portion 6*b* and the lower connecting portion 6*c* are molded integrally with each other.

An upper end 8 of the shaft attaching portion 6*a* of the hosel portion 6 is recessed downward from an upper surface 9 of the crown portion 4, as shown in FIG. 2. In the hosel portion 6, the upper connecting portion 6*b* that integrally connects the upper end 8 of the shaft attaching portion 6*a* to the crown portion 4 is integrally formed with the shaft attaching portion 6*a*. The upper connecting portion 6*b* is formed substantially like the end of a trumpet, that is, the section of the outer surface, facing upward, of the upper connecting portion 6*b* flares (gradually increases) from its lower end to its upper end so as to be upwards convex so as to define a recess 10 between the intermediate portion 2*b* and upper connection portion 6*b*. The inner diameter of the lower end of the upper connecting portion 6*b* is substantially equal to the inner diameter of the upper end 8 of the shaft attaching portion 6*a*. An inner diameter D1 of the upper end of the upper connecting portion 6*b* is about 18 mm in the case of the embodiment shown in FIGS. 1 and 2 but generally preferably falls within the range of about 10 mm to about 30 mm from the practical viewpoint, and more preferably falls within the range of about 12 mm to about 24 mm. The average radius of curvature R1 of the convex surface of the upper connecting portion 6*b* (the average radius of curvature of the surface of the sectional portion in FIG. 2 around the entire circumference of the shaft 2) is about 4.5 mm in the embodiment shown in FIGS. 1 and 2 but generally preferably falls within the range of about 2 mm to about 12 mm from the practical viewpoint, and more preferably falls within the range of about 3 mm to about 8 mm.

A length L1 of the cylindrical shaft attaching portion 6*a* along a center line 25 (i.e., a straight line extending through the axis of the shaft 2 or a shaft insertion hole 13) of the shaft 2 is about 30 mm in the embodiment shown in FIGS. 1 and 2 but generally preferably falls within the range of about 15 mm to about 45 mm from the practical viewpoint, and more preferably falls within the range of about 20 mm to about 40 mm. An inner diameter D2 of the shaft attaching portion 6*a* (i.e., the diameter of the shaft insertion hole 13) is about 8.5 mm in the embodiment shown in FIGS. 1 and 2 but generally preferably falls within the range of about 3 mm to about 15 mm from the practical viewpoint, and more preferably falls within the range of about 5 mm to about 12 mm. The thickness of the shaft attaching portion 6*a* is about 4 mm in the embodiment shown in FIGS. 1 and 2 but generally preferably falls within the range of about 1 mm to about 6 mm from the practical viewpoint, and more preferably falls within the range of about 2 mm to about 5 mm.

A length L2 of the upper connecting portion 6*b* along the center line 25 of the shaft 2 is about 6 mm in the embodiment shown in FIGS. 1 and 2 but generally preferably falls within the range of about 2 mm to about 15 mm from the practical viewpoint, and more preferably falls within the range of about 4 mm to about 10 mm. The thickness of the upper connecting portion 6*b* as a whole is preferably substantially equal to the thickness of the shaft attaching portion 6*a*. However, the thickness of the upper connecting portion 6*b* at the connecting portion between the upper end of the upper connecting portion 6*b* and the crown portion 4 may gradually decrease toward the crown portion 4 to match the thickness of the crown portion 4.

The lower connecting portion 6*c* has a shape which nearly fills the gap between the lower end of the shaft attaching portion 6*a* (i.e., the lower end of the shaft insertion hole 13) and the inner side surface of the sole portion 3. Accordingly, the lower connecting portion 6*c* has such a shape as to obliquely cut a cylinder substantially in half from near the upper edge or from a little lower part of the upper edge of the cylinder to near the lower edge or to a little upper part of the lower edge of the cylinder. A length L3 of the lower connecting portion 6*c* along the center line 25 of the shaft 2 is about 10 mm in the embodiment shown in FIGS. 1 and 2 but generally preferably falls within the range of about 3 mm to about 30 mm from the practical viewpoint, and more preferably falls within the range of about 6 mm to about 20 mm.

The ratio of the length L2 of the upper connecting portion 6*b* along the center line 25 of the shaft 2 to the length L1 of the cylindrical shaft attaching portion 6*a* along the center line 25 (i.e., L2/L1) is about 1/5 in the embodiment shown in FIGS. 1 and 2 but generally preferably falls within the range of about 1/20 to about 1/2 from the practical viewpoint, and more preferably falls within the range of about 1/10 to about 1/3. The ratio of the length L3 of the lower connecting portion 6*c* along the center line 25 of the shaft 2 to the length L1 of the shaft attaching portion 6*a* along the center line 25 (i.e., L3/L1) is about 1/3 in the embodiment shown in FIGS. 1 and 2 but generally preferably falls within the range of about 1/15 to about 2/5 from the practical viewpoint, and more preferably falls within the range of about 1/6 to about 1/2.

The lower connecting portion 6*c* need not always have a solid structure, as in the embodiment shown in FIGS. 1 and 2, but may have a hollow structure in a region hatched with alternate long and a short dashed lines in FIG. 2. In this case, the lower connecting portion 6*c* has a cup-like shape. The cup-like lower connecting portion 6*c* has a bottom plate portion 27 (i.e., a connecting portion with the shaft attaching portion 6*a*). The thickness of the bottom plate portion 27 is about 3 mm in the embodiment shown in FIG. 2 but generally preferably falls within the range of about 1 mm to about 10 mm from the practical viewpoint, and more preferably falls within the range of about 2 mm to about 6 mm. In this case, this bottom plate portion 27 may be omitted, so that the internal space of the shaft attaching portion 6*a* and the internal space of the lower connecting portion 6*c* may communicate with each other. The lower connecting portion 6*c* may be formed substantially the same as the upper connecting portion 6*a* (that is, like the end of a trumpet), so that the section of the outer surface, facing downward, of the lower connecting portion 6*c* flares (gradually increases) from its upper end to its lower end so as to be downwards convex. In these cases, the weight of the head 1 can be decreased. In the latter case, the discussion concerning L3/L1 described above about the length L3 of the funnel-shaped lower connecting portion 6*c* along the center line 25 almost applies.

The distal end portion 2*a* of the substantially cylindrical shaft 2 is pressed into the shaft insertion hole 13 of the cylindrical shaft attaching portion 6*a* of the hosel portion 6 and abuts against the upper side surface of the lower connecting portion 6*c* of the hosel portion 6. The outer circumferential surface of the distal end portion 2*a* is fixed to the inner circumferential surface of the shaft attaching portion 6*a* by adhesion. Accordingly, the shaft attaching portion 6*a* signifies that a portion of the hosel portion 6 which fixes the outer circumferential surface of the shaft 2 (i.e., a portion which is constantly in contact with the distal end portion 2*a* of the shaft 2 directly or indirectly through an adhesive or the like, or a portion which comes into contact with the distal end portion 2*a* of the shaft 2 during a normal golf swing). The distal end portion 2*a* of the shaft 2 extends with a tilt in the inclined direction of the shaft attaching portion 6*a* of the hosel portion 6.

The shaft insertion hole 13 of the shaft attaching portion 6*a* of the hosel portion 6 need not always have a substantially circular section but may have a substantially oval or elliptic section elongated (i.e., short substantially in the forward-to-backward direction of the head 1) in the inclined direction described above (i.e., the inclined direction of the shaft attaching portion 6*a* of the hosel portion 6.

In this case, the strength of the hosel portion 6 against a load which is applied to the hosel portion 6 when the toe side of the head 1 moves downward can be increased.

In the case of the head 1 having the hosel portion 6 shown in FIGS. 1 and 2, a perpendicular 26 dropped downward from a sweet spot S of the base surface of the face portion 5 to the center line 25 of the shaft 2 perpendicularly intersects the distal end portion 2*a* of the shaft 2. Accordingly the stress applied by the golf ball on the face surface of the face portion 5 is transmitted from the head 1 to the shaft 2 quickly and smoothly. Therefore, the spring motion of the shaft 2 that drives the head 1 can be utilized effectively, and damage to the hosel portion 6 can be prevented effectively.

For example, the weight of the head 1 having the arrangement shown in FIGS. 1 and 2 can be set to fall within the range of about 170 g to about 250 g, and its apparent volume can be set to fall within the range of about 150 cc to about 360 cc.

In the driver having the arrangement shown in FIGS. 1 and 2, the shaft attaching portion 6*a* that serves as the fixing portion that fixes the outer circumferential surface of the distal end portion 2*a* of the shaft 2 to the head 1 is formed in the hosel portion 6 such that the upper end of the shaft attaching portion 6*a* is located beneath the surface of the crown portion 4. The upper end of the shaft attaching portion 6*a* and the surface of the crown portion 4 are connected to each other with the upper connecting portion 6*b* having a large diameter. Since the attaching position of the shaft 2 to the head 1 is further below the surface of the crown portion 4, the effective length of the shaft 2 that can flex during the golf swing can be extended at its distal end portion 2*a*. As a result, the head speed can be increased by sufficiently utilizing the flexure of the distal end portion 2*a* of the shaft 2, and damage to the shaft 2 can be prevented effectively.

Second Embodiment

A golf club according to the second embodiment of this invention shown in FIGS. 3 and 4 will be described.

Figure 3:
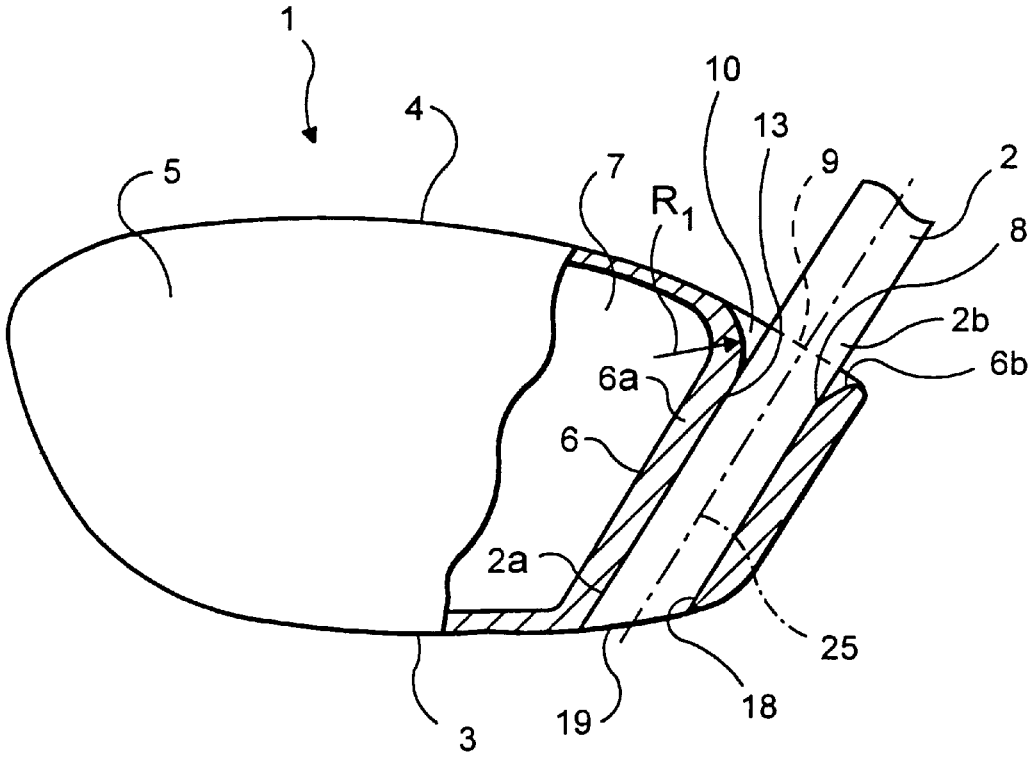
FIG. 3 is a front view similar to FIG. 1 of a golf club according to the second embodiment of this invention.
Figure 4:
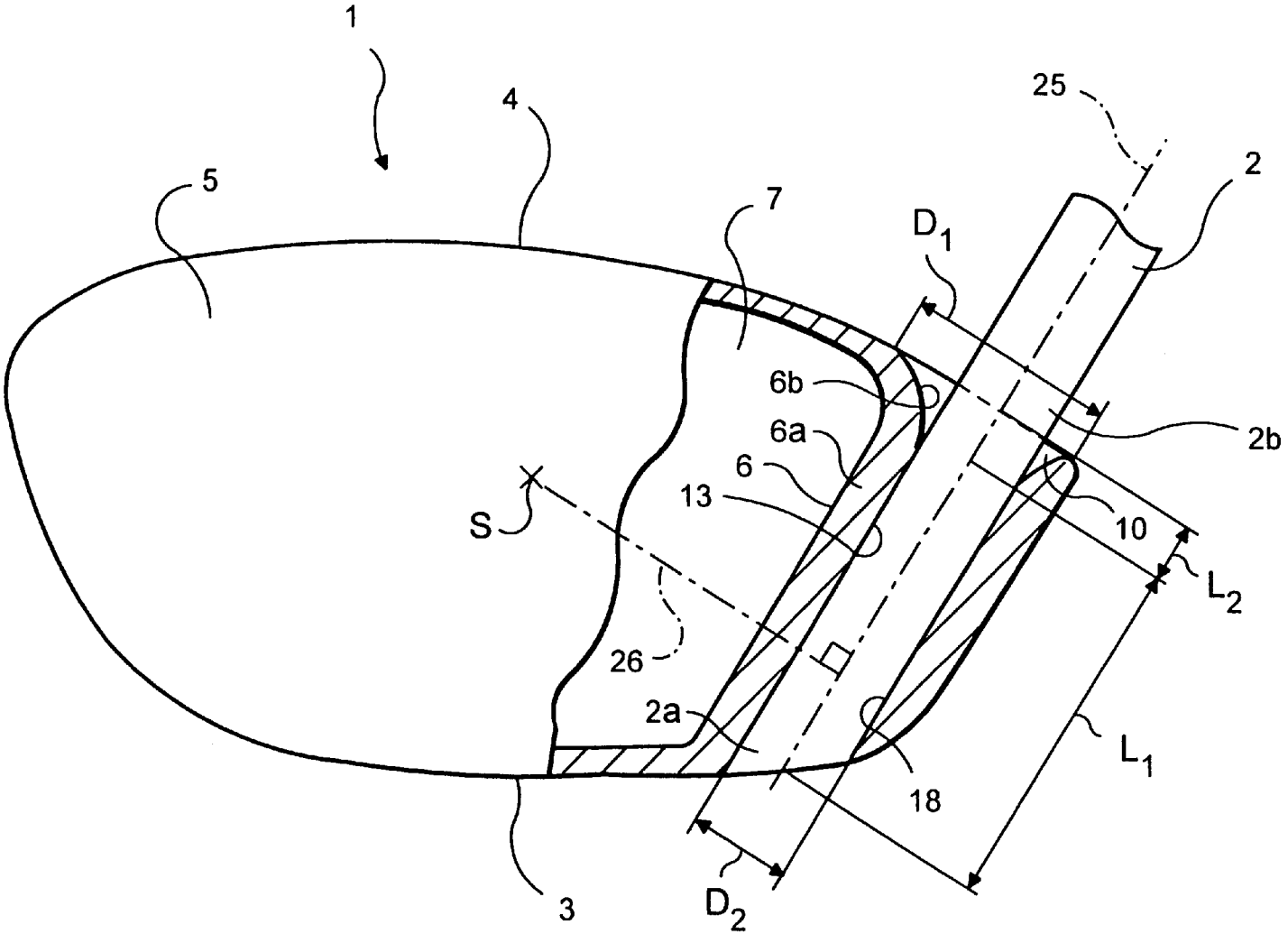
FIG. 4 is an enlarged view of FIG. 3.

The golf club shown in FIGS. 3 and 4 has substantially the same arrangement as that of the golf club according to the first embodiment of this invention shown in FIGS. 1 and 2 except that the structure of its hosel portion 6 differs and accordingly the structure of its sole portion 3 and the position of a distal end portion 2*a* of its shaft 2 with respect to the hosel portion 6 slightly differ from their counterparts (note that scores formed in a face portion 5 are omitted in FIGS. 3 and 4 as well). Therefore, the description concerning the golf club shown in FIGS. 1 and 2 applies to the golf club shown in FIGS. 3 and 4 except for the portions concerning the differences described above. In the second embodiment, portions that are common with the first embodiment are denoted by the same reference numerals as in the first embodiment, and a detailed description thereof will be omitted.

The hosel portion 6 shown in FIGS. 3 and 4 is different from the hosel portion 6 shown in FIGS. 1 and 2 in that, in FIGS. 3 and 4, a shaft attaching portion 6*a* extends downward to be integrally connected to the inner side surface of the sole portion 3 directly, and that an opening 18 substantially corresponding to a shaft insertion hole 13 of the shaft attaching portion 6*a* is formed in the sole portion 3. Hence, in FIGS. 3 and 4, the distal end portion 2*a* of the shaft 2 has a distal end face substantially inclined along the lower end of the opening 18.

A length L1 of the shaft attaching portion 6*a* along a center line 25 of the shaft 2 is about 40 mm in the embodiment shown in FIGS. 3 and 4 but generally preferably falls within the range of about 20 mm to about 80 mm from the practical viewpoint, and more preferably falls within the range of about 30 mm to about 60 mm. The ratio of a length L2 of an upper connecting portion 6*b* along the center line 25 to the length L1 of the cylindrical shaft attaching portion 6*a* along the center line 25 (i.e., L2/L1) is about 1/7 in the embodiment shown in FIGS. 3 and 4 but generally preferably falls within the range of about 1/25 to about 1/3 from the practical viewpoint, and more preferably falls within the range of about 1/15 to about 1/4. Regarding the numerical values other than L1 and L2/L1, the above description concerning the golf club shown in FIGS. 1 and 2 applies to the golf club shown in FIGS. 3 and 4 likewise. In the golf club shown in FIGS. 3 and 4, if no opening 18 is formed in the sole portion 3, the shaft attaching portion 6*a* can have a bottom. In this case, an inclined distal end face 19 of the distal end portion 2*a* of the shaft 2 may be made to abut against the inner side surface of the sole portion 3.

Third Embodiment

A golf club according to the third embodiment of this invention shown in FIGS. 5 and 6 will be described.

Figure 5:
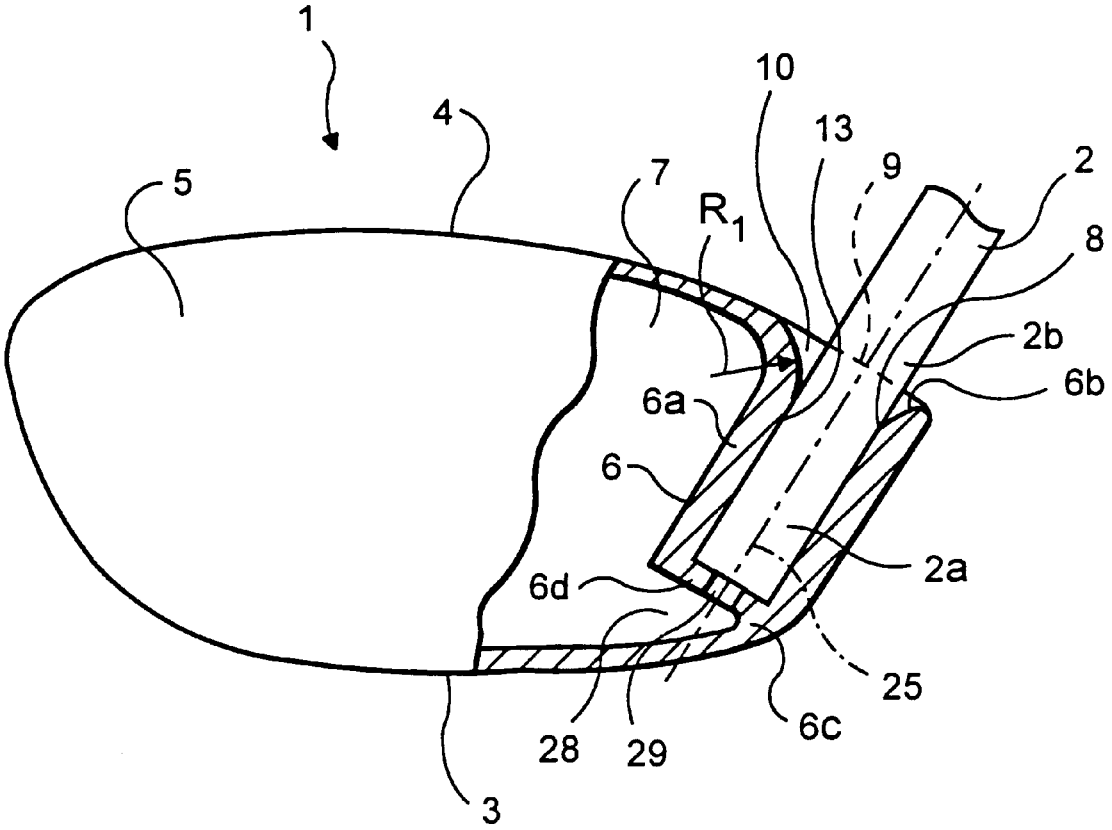
FIG. 5 is a front view similar to FIG. 1 of a golf club according to the third embodiment of this invention.
Figure 6:
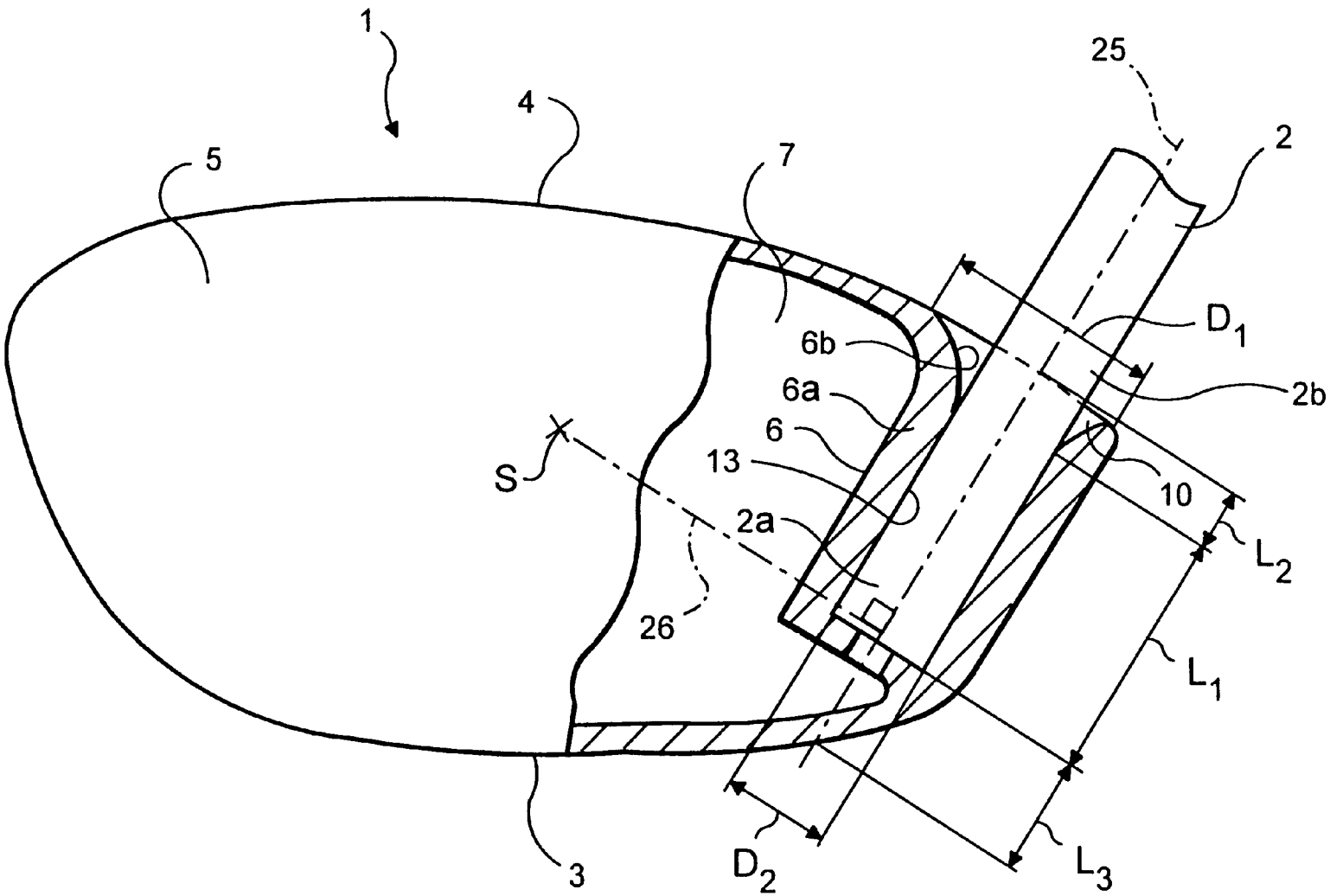
FIG. 6 is an enlarged view of FIG. 5.

The golf club shown in FIGS. 5 and 6 has substantially the same arrangement as that of the golf club according to the first embodiment of this invention shown in FIGS. 1 and 2 except that the structure of its hosel portion 6 differs (note that scores formed in a face portion 5 are omitted in FIGS. 5 and 6 as well). Therefore, the description concerning the golf club shown in FIGS. 1 and 2 applies to the golf club shown in FIGS. 5 and 6 except for the portions concerning the difference described above. In the third embodiment, portions that are common with the first embodiment are denoted by the same reference numerals as in the first embodiment, and a detailed description thereof will be omitted.

The hosel portion 6 shown in FIGS. 5 and 6 is different from the hosel portion 6 shown in FIGS. 1 and 2 in such a point that most of its lower connecting portion 6*c* is omitted except a very little of the lower connecting portion 6*c* remaining on the heel side portion of the head 1 and, instead, an end plate portion 6*d* is provided integrally with a shaft attaching portion 6*a* at the lower end of the portion 6*a*. Accordingly, a gap 28 is formed between the end plate portion 6*d* and a sole portion 3. A central hole 29 which is substantially circular, for example, is formed at substantially the central position of the end plate portion 6*d*. The diameter of the central hole 29 is about 5 mm in the embodiment shown in FIGS. 5 and 6 but generally preferably falls within the range of about 2 mm to about 10 mm from the practical viewpoint, and more preferably falls within the range of about 4 mm to about 8 mm. That portion of the end plate portion 6*d* which is closer to the heel side than to the central hole 29 is integrally connected to the sole portion 3 with the lower connecting portion 6*c*.

Regarding the numerical values such as L1, L2, L3, L2/L1 and L3/L1, the above description concerning the golf club shown in FIGS. 1 and 2 applies to the golf club shown in FIGS. 5 and 6 likewise. Note that in the golf club shown in FIGS. 1 and 2, L3 indicates the length of the lower connecting portion 6*c* along the center line 25 of the shaft 2, whereas in the golf club shown in FIGS. 5 and 6, it indicates the length between the lower end of the cylindrical shaft attaching portion 6*a* and the bottom surface of the sole portion 3 along the center line 25.

A distal end portion 2*a* of the substantially cylindrical shaft 2 is pressed into a shaft insertion hole 13 of the cylindrical shaft attaching portion 6*a* of the hosel portion 6 shown in FIGS. 5 and 6, and abuts against the upper surface of the end plate portion 6*d* of the hosel portion 6. The distal end portion 2*a* is fixed to the inner circumferential surface of the shaft attaching portion 6*a* by adhesion.

In the golf club shown in FIGS. 5 and 6, the central hole 29 need not always be formed in the end plate portion 6*d*, and the lower connecting portion 6*c* can be omitted. Furthermore, both the lower connecting portion 6*c* and the end plate portion 6*d* can be omitted. In the latter case, the inclined distal end face of the distal end portion 2*a* of the shaft 2 may be made to abut against the inner side surface of the sole portion 3. Furthermore, in the above latter case, the hosel portion 6 may be substantially vertically inverted upside down along the center line 25 of the shaft 2. In this case, the hosel portion 6 is not supported mainly by a crown portion 4, as in FIGS. 5 and 6, but by the heel side portions of the sole portion 3 and crown portion 4. Having described specific preferred embodiments of this invention with reference to the accompanying drawings, it is to be understood that the invention is not limited to that precise embodiments, and that various changes and modifications may be effected therein by one skilled in the art without departing from the scope or spirit of the invention as defined in the appended claims.

For example, in the first to third embodiments described above, this invention is applied to a driver. However, this invention can also be applied to wood clubs other than the driver, and further to a putter and as iron clubs required.

In the first to third embodiments described above, the head is constituted by a hollow shell body. However, in this invention, the head need not always be hollow, and the hollow shell body may be filled with a filler, e.g., a foamed synthetic resin.

What is claimed is:

1. A golf club head comprising:

a hosel portion including a tubular shaft attaching portion for fixing a distal end portion of a shaft to said head, wherein said hosel portion has an upper connecting portion which is located below a corresponding upper surface of a crown portion of said head, said upper connecting portion connecting said crown portion to said shaft attaching portion, said upper connecting portion defining a recess below said crown portion to allow a portion of the shaft to be disposed in said recess between said crown portion and said shaft attaching portion thereby to allow said portion of the shaft to flex.

2. A head according to claim 1 wherein:

said hosel portion further has an upper connecting portion that connects said upper end of said cylindrical shaft attaching portion to said crown portion.

3. A head according to claim 2 wherein:

the section of the outer surface of said upper connecting portion flares from its lower end to its upper end so as to be upwards convex.

4. A head according to claim 3 wherein:

said convex outer surface of said upper connecting portion has an average radius of curvature that falls within a range of about 2 mm to about 12 mm.

5. A head according to claim 4 wherein:

the average radius of curvature of said convex outer surface of said upper connecting portion falls within a range of about 3 mm to about 8 mm.

6. A head according to claim 2 wherein:

said upper connecting portion has an upper end with an inner diameter that falls within a range of about 10 mm to about 30 mm.

7. A head according to claim 6 wherein:

the inner diameter of said upper end of said upper connecting portion falls within a range of about 12 mm to about 24 mm.

8. A head according to claim 2 wherein:

said upper connecting portion has a length which falls within a range of about 2 mm to about 15 mm along a center line of said shaft.

9. A head according to claim 8 wherein:

the length of said upper connecting portion falls within a range of about 4 mm to about 10 mm along the center line of said shaft.

10. A head according to claim 2 wherein:

said hosel portion further has a lower connecting portion that connects a lower end of said tubular shaft attaching portion to a sole portion;

a ratio of a length of said upper connecting portion along the center line of said shaft to a length of said tubular shaft attaching portion along the center line falls within a range of about 1/20 to about 1/2; and a ratio of a length of said lower connecting portion along the center line to the length of said tubular shaft attaching portion falls within a range of about 1/15 to about 2/5.

11. A head according to claim 10 wherein:

a ratio of a length of said upper connecting portion along the center line of said shaft to a length of said tubular shaft attaching portion along the center line falls within a range of about 1/10 to about 1/3; and a ratio of a length of said lower connecting portion along the center line to a length of said tubular shaft attaching portion falls within a range of about 1/6 to about 1/2.

12. A head according to claim 2 wherein:

said tubular shaft attaching portion has a lower end which is directly connected to a sole portion; and a ratio of a length of said upper connecting portion along a center line of said shaft to a length of said tubular shaft attaching portion along the center line falls within a range of about 1/25 to about 1/3.

13. A head according to claim 12 wherein:

a ratio of a length of said upper connecting portion along the center line of said shaft to a length of said tubular shaft attaching portion along the center line falls within a range of about 1/15 to about 1/4.

14. A head according to claim 2 wherein:

said tubular shaft attaching portion has a lower end which is located above a sole portion, said hosel portion further has an end plate portion formed at a lower end portion of said tubular shaft attaching portion so as to locate above said sole portion through a gap;

a ratio of a length of said upper connecting portion along a center line of said shaft to a length of said tubular shaft attaching portion along the center line falls within a range of about 1/20 to about 1/2; and a ratio of a length between said lower end of said tubular shaft attaching portion and a bottom surface of said sole portion along the center line to a length of said tubular shaft attaching portion along the center line falls within a range of about 1/15 to about 2/5.

15. A head according to claim 14 wherein:

a ratio of a length of said upper connecting portion along the center line of said shaft to a length of said tubular shaft attaching portion along the center line falls within a range of about 1/10 to about 1/3; and a ratio of a length between said lower end of said tubular shaft attaching portion and said bottom surface of said sole portion along the center line to a length of said tubular shaft attaching portion along the center line falls within a range of about 1/6 to about 1/2.

16. A golf club comprising:

a golf club head provided with a hosel portion having a tubular shaft attaching portion for fixing a distal end portion of a shaft to said head, wherein said portion has an upper connecting portion which is located below a corresponding upper surface of a crown portion of said head, said upper connecting portion connecting said crown portion to said shaft attaching portion, said upper connecting portion defining a recess below said crown portion; and a shaft having a distal end portion which is fixed to said tubular shaft attaching portion of said hosel portion of said head such that a portion of said shaft is disposed in said recess between said crown portion and said shaft attaching portion thereby to allow said portion of said shaft to flex.

* * * * *